US011607896B2

(12) United States Patent
Endo

(10) Patent No.: US 11,607,896 B2
(45) Date of Patent: Mar. 21, 2023

(54) MEDIUM CUTTER AND LIQUID DISCHARGE APPARATUS

(71) Applicant: Hirotaka Endo, Kanagawa (JP)

(72) Inventor: Hirotaka Endo, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 515 days.

(21) Appl. No.: 16/712,471

(22) Filed: Dec. 12, 2019

(65) Prior Publication Data

US 2020/0198379 A1 Jun. 25, 2020

(30) Foreign Application Priority Data

Dec. 25, 2018 (JP) ..... JP2018-241589

(51) Int. Cl.

| | |
|---|---|
| ***B26D 1/24*** | (2006.01) |
| ***B41J 11/70*** | (2006.01) |
| *B41J 11/66* | (2006.01) |
| *B26D 1/00* | (2006.01) |
| *B26D 1/04* | (2006.01) |
| *B26D 7/00* | (2006.01) |
| *B26D 1/18* | (2006.01) |

(52) U.S. Cl.

CPC ..... *B41J 11/706* (2013.01); *B26D 1/245* (2013.01); *B26D 1/045* (2013.01); *B26D 1/185* (2013.01); *B26D 2001/0066* (2013.01); *B26D 2007/005* (2013.01); *B41J 11/663* (2013.01)

(58) Field of Classification Search

CPC ..... B26D 1/185; B26D 1/245
USPC ..... 83/912, 614, 455
See application file for complete search history.

(56) References Cited

U.S. PATENT DOCUMENTS

| | | | | |
|---|---|---|---|---|
| 1,572,304 A * | 2/1926 | Bunting | D06H 7/02 | 83/614 |
| 2,649,656 A * | 8/1953 | Hedrick | B43M 7/002 | 30/294 |
| 2,665,757 A * | 1/1954 | Stevens | B29D 30/46 | 83/272 |
| 2,761,378 A * | 9/1956 | Lancaster | B30B 15/00 | 83/624 |

(Continued)

FOREIGN PATENT DOCUMENTS

| | | |
|---|---|---|
| JP | H0294097 U | 7/1990 |
| JP | H1178140 A | 3/1999 |

(Continued)

OTHER PUBLICATIONS

Japanese office action; Application 2018-241589; dated Aug. 2, 2022.

*Primary Examiner* — Kenneth E Peterson
(74) *Attorney, Agent, or Firm* — Duft & Bornsen, PC

(57) ABSTRACT

A medium cutter includes a conveyor configured to convey a medium in a conveyance direction, a cutter configured to cut the medium from one end of medium in a cutting direction orthogonal to the conveyance direction, a first holder movable to contact a first surface of the one end of medium, and a second holder configured to contact a second surface of the one end of medium opposite the first surface. The first holder is disposed downstream of the cutter in the conveyance direction, and the first holder moves to the one end of medium to pinch and hold the one end of medium between the first holder and the second holder.

10 Claims, 17 Drawing Sheets

(56) References Cited

U.S. PATENT DOCUMENTS 3,142,217 A * 7/1964 Busse ..... B65H 35/0086 83/649
3,370,497 A * 2/1968 Busse ..... B21C 47/34 83/649
4,273,738 A * 6/1981 Spengler ..... B29C 51/32 72/448
4,516,451 A * 5/1985 Takeshita ..... B26D 3/02 83/486.1
4,872,384 A * 10/1989 Borzym ..... B23D 35/002 83/454
5,293,795 A * 3/1994 Osawa ..... B26D 3/003 83/16
5,524,515 A * 6/1996 Boda ..... B26D 5/02 83/485
5,582,053 A * 12/1996 Chubb ..... B23D 31/00 83/485
6,098,515 A * 8/2000 Daley, Jr. ..... B26D 7/22 83/485
6,227,088 B1 * 5/2001 Cestonaro ..... B65H 19/105 83/563
6,260,457 B1 7/2001 Hakkaku
6,895,848 B1 * 5/2005 Svensson ..... A47K 10/38 83/649
8,316,746 B2 * 11/2012 Hediger ..... B26D 7/025 83/72
2005/0109180 A1 * 5/2005 Schultz ..... B26D 1/185 83/614
2006/0260455 A1 * 11/2006 Yeghiayan ..... B26D 7/015 83/455
2007/0125214 A1 * 6/2007 Dong ..... B26D 1/205 83/485
2013/0034376 A1 2/2013 Saiga
2014/0063123 A1 3/2014 Saiga et al.
2015/0247359 A1 9/2015 Ogawa et al.
2015/0253728 A1 9/2015 Endo
2016/0121634 A1 5/2016 Saiga et al.
2016/0297212 A1 10/2016 Saiga et al.
2017/0368849 A1 12/2017 Masunaga
2018/0311983 A1 11/2018 Saiga

FOREIGN PATENT DOCUMENTS

JP 2001-009775 1/2001
JP 2001-105677 4/2001
JP 2001-328303 11/2001
JP 2007-062045 3/2007
JP 2009-179004 8/2009
JP 2018-002479 1/2018

* cited by examiner

MEDIUM CUTTER AND LIQUID DISCHARGE APPARATUS

CROSS-REFERENCE TO RELATED APPLICATIONS

The present disclosure is based on and claims priority pursuant to 35 U.S.C. § 119(a) to Japanese Patent Application No. 2018-241589, filed on Dec. 25, 2018 in the Japan Patent Office, the entire disclosure of which is hereby incorporated by reference herein.

BACKGROUND

Technical Field

The present disclosure relates to a medium cutter and a liquid discharge apparatus.

Related Art

In recent years, information tends to be digitized, and an image processing apparatus such as a printer used to output the digitized information has become indispensable equipment. As the image processing apparatus outputting the digitized information, there is an image processing apparatus including a cutter that cuts a sheet after the sheet is printed out.

SUMMARY

In an aspect of the present disclosure, there is provided a medium cutter that includes a conveyor configured to convey a medium in a conveyance direction, a cutter configured to cut the medium from one end of medium in a cutting direction orthogonal to the conveyance direction, a first holder movable to contact a first surface of the one end of medium, and a second holder configured to contact a second surface of the one end of medium opposite the first surface. The first holder is disposed downstream of the cutter in the conveyance direction, and the first holder moves to the one end of medium to pinch and hold the one end of medium between the first holder and the second holder.

BRIEF DESCRIPTION OF THE DRAWINGS

The aforementioned and other aspects, features, and advantages of the present disclosure would be better understood by reference to the following detailed description when considered in connection with the accompanying drawings, wherein.

Figure 1:
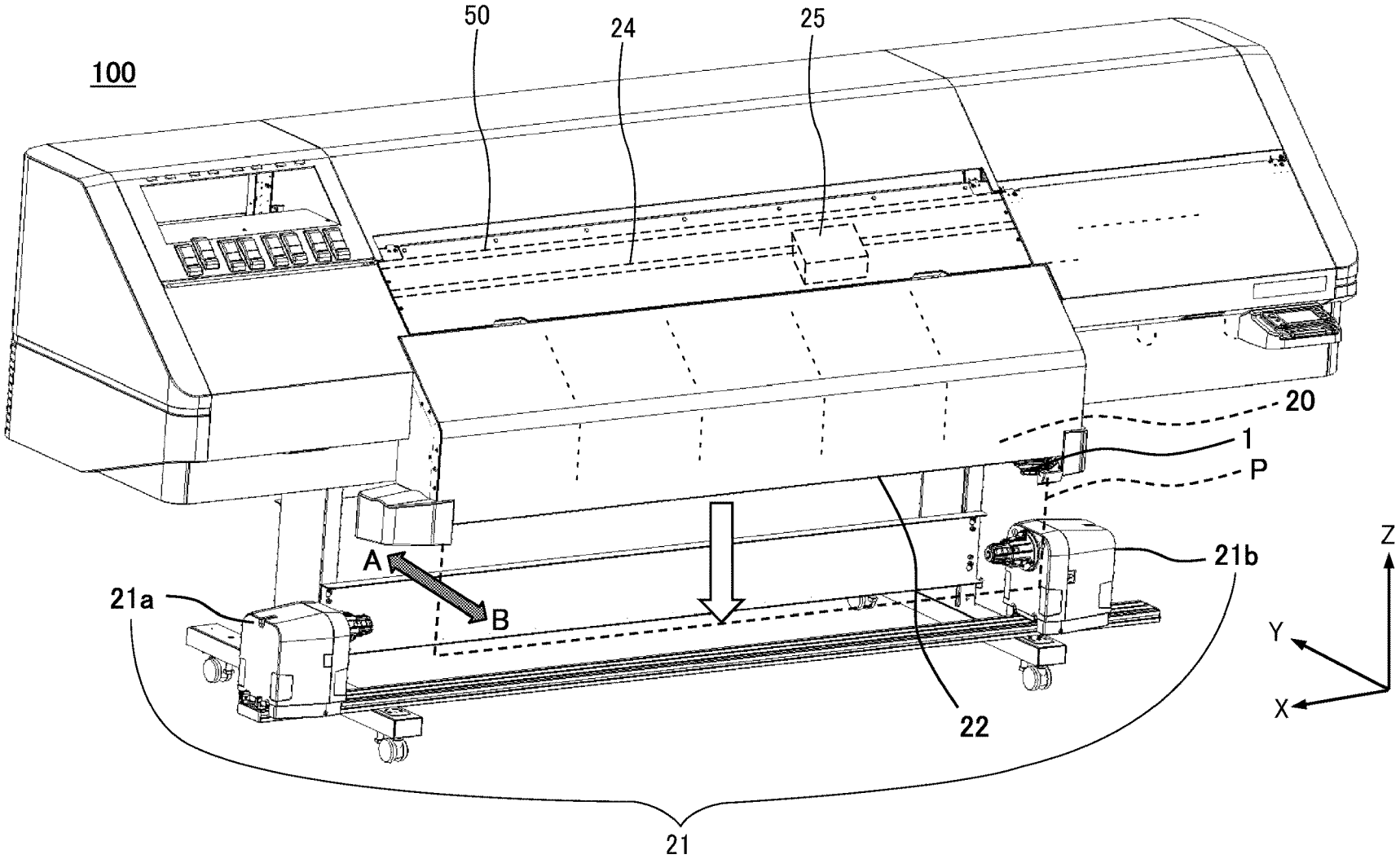
FIG. 1 is a schematic structural view of a liquid discharge apparatus according to an embodiment of the present disclosure.

The accompanying drawings are intended to depict embodiments of the present disclosure and should not be interpreted to limit the scope of the present disclosure. The accompanying drawings are not to be considered as drawn to scale unless explicitly noted.

DETAILED DESCRIPTION

In describing embodiments illustrated in the drawings, specific terminology is employed for the sake of clarity. However, the present disclosure is not intended to be limited to the specific terminology so selected and it is to be understood that each specific element includes all technical equivalents that operate in a similar manner and achieve similar results.

Although the embodiments are described with technical limitations with reference to the attached drawings, such description is not intended to limit the scope of the disclosure and all of the components or elements described in the embodiments of the present disclosure are not necessarily indispensable.

Referring now to the drawings, a medium cutter 20 and a liquid discharge apparatus 100 including the medium cutter 20 according to the present disclosure are described below.

Note that, in the description of the present disclosure, a serial type inkjet printer is described below as an example of the liquid discharge apparatus 100. However, the medium cutter 20 may also be mounted on a line head type inkjet printer or an image forming apparatus including an electrophotographic image forming device. In the drawings for explaining the following embodiments, the same reference codes are allocated to elements (members or components) having the same function or shape and redundant descriptions of the same function or shape are omitted below.

The liquid discharge apparatus 100 includes a liquid discharge head 25 to discharge a liquid onto the medium (sheet P) and the medium cutter 20. The liquid discharge head 25 discharges the liquid onto the sheet P while the liquid discharge head 25 reciprocally moves along a guide rod 24 in an X direction in FIG. 1 so that an image is formed one the sheet P in a width direction (X direction) and a conveyance direction (Z direction) of the sheet P.

FIG. 1 is a schematic structural view of the liquid discharge apparatus 100 according to the present disclosure. The liquid discharge apparatus 100 discharges liquid onto a sheet P, such as a roll sheet that is a recording medium, to perform image formation output. The liquid discharge apparatus 100 includes: an image formation device as the image forming device; a conveyor that conveys a sheet P; and the medium cutter 20.

The sheet P on which an image has been formed is conveyed from a sheet ejection port 22 in a direction of a white arrow in FIG. 1 by a conveyance roller 50 provided as the conveyor, and a winding device 21. Then, the sheet is ejected to the outside of a housing of the liquid discharge apparatus 100. In the present disclosure, a trajectory of the sheet P during the conveyance in the liquid discharge apparatus 100 is defined as a conveyance path of the sheet P.

The sheet P that has been ejected from the sheet ejection port 22 is wound up by the winding device 21 arranged on a downstream side in a conveyance direction of the sheet P. The sheet P is conveyed downward in the Z direction as indicated by white arrow in FIG. 1.

Thus, to prevent the winding device 21 from winding up the sheet P on which the image formation and output have been completed, the conveyance of the sheet P is stopped and then the sheet P is cut.

To solve the above-described problems, the liquid discharge apparatus 100 according to the present disclosure includes, in the vicinity of the sheet ejection port 22, a cutter 1 that is a cutter to cut the sheet P. The cutter 1 cuts the sheet P while being moved in a direction orthogonal to the conveyance direction of the sheet P. Accordingly, since the sheet P is cut in the direction orthogonal to the conveyance direction of the sheet P at a predetermined position in a sub-scanning direction of the sheet P, it is possible to obtain a printed matter on which a desired image is formed.

Figure 2:
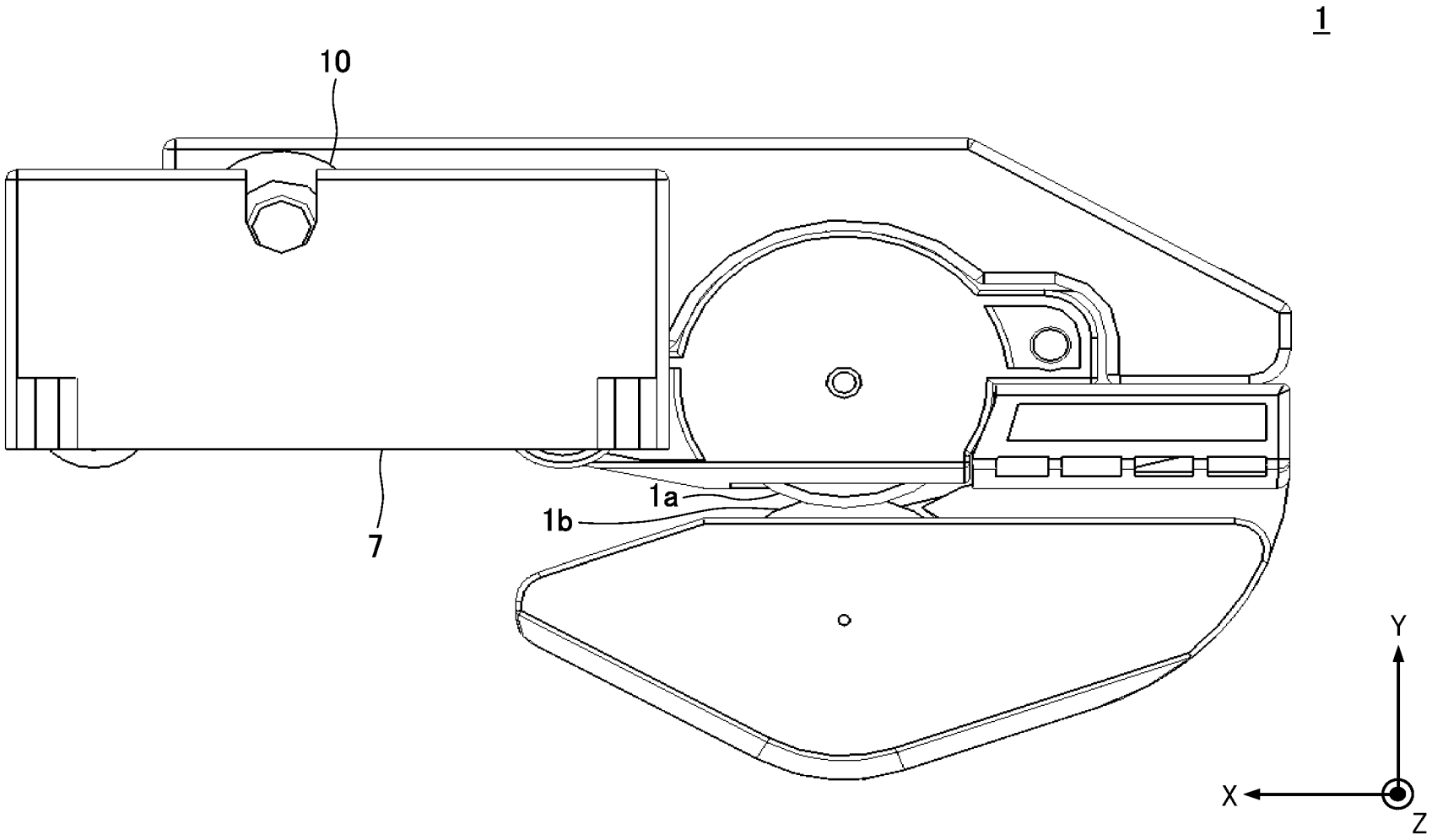
FIG. 2 is a schematic structural view of a cutter mounted on the liquid discharge apparatus according to the embodiment of the present disclosure.

Next, a cutting mode of a sheet P by the cutter 1 is described below. FIG. 2 is a schematic structural view of the cutter 1 according to the present disclosure. The cutter 1 includes two round blades 1*a* and 1*b*. The round blades 1*a* and 1*b* are arranged in a manner such that edges of the round blades 1*a* and 1*b* overlap with each other.

The round blade 1*a* is arranged on a first surface of the sheet P (a surface of the sheet P moved from A to B as indicated by a shaded arrow in FIG. 1), and the round blade 1*b* is arranged on a second surface of the sheet P (a surface of the sheet P moved from B to A as indicated by the shaded arrow in FIG. 1). When the cutter 1 is driven, the round blades 1*a* and 1*b* are rotated while sandwiching the sheet P between the round blade 1*a* and the round blade 1*b*. Thus, the cutter 1 cuts the sheet P with the round blade 1*a* and 1*b*.

To rotate the round blades 1*a* and 1*b*, the cutter 1 includes: a shuttle 7 driven along a cutter rail 4 (see FIG. 3); and a rubber roller 10 provided in a manner abutting on the shuttle 7. When the round blade 1*a* and the round blade 1*b* are rotated while sandwiching the sheet P, cutting ability for the sheet P is enhanced. Thus, it is possible to suppress failure (sheet jam) such as sheet jam caused at the time of cutting the sheet P.

Figure 3:
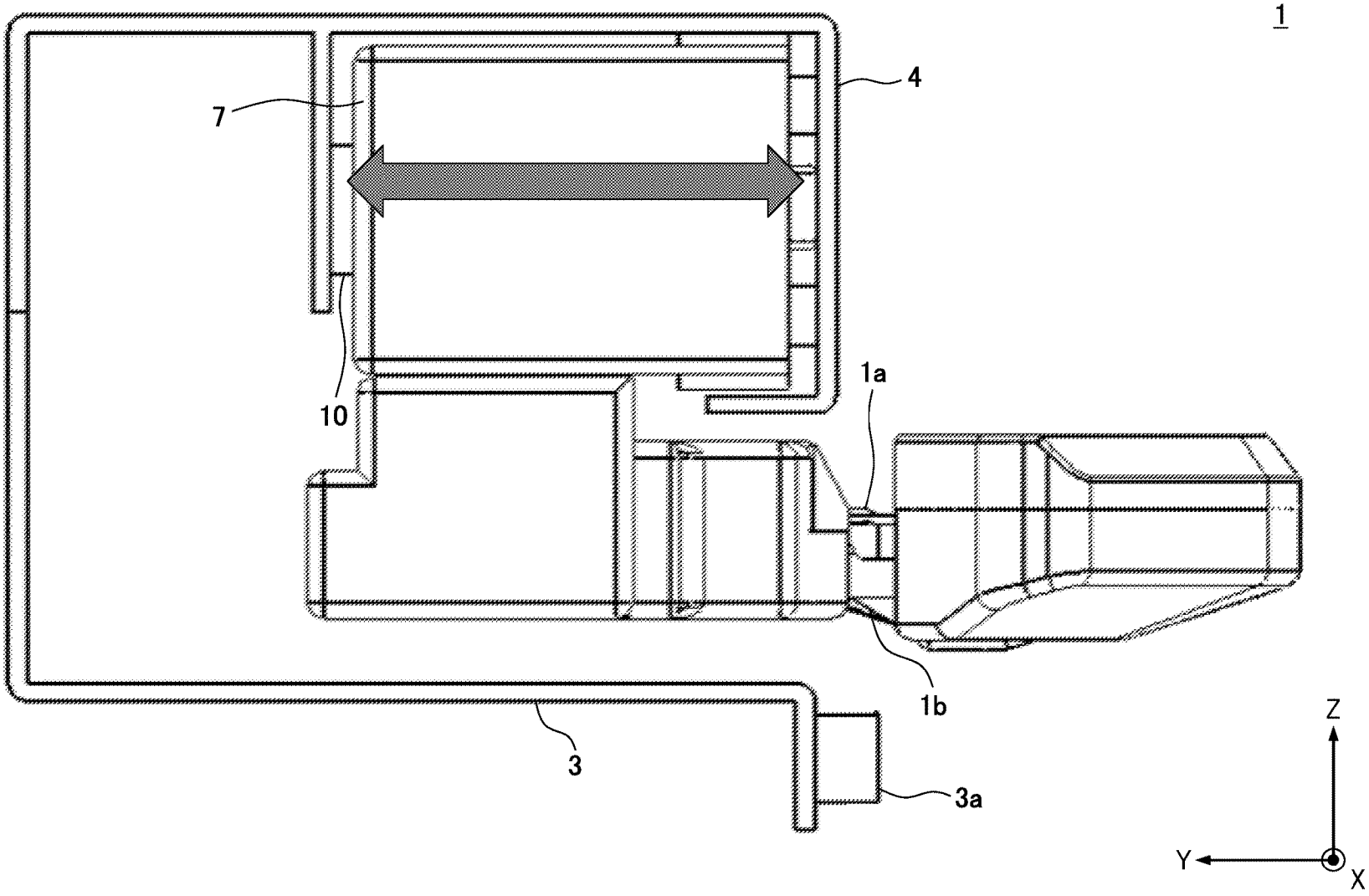
FIG. 3 is a schematic cross-sectional view of the cutter according to the embodiment of the present disclosure.

Next, a mechanism to rotate the round blades 1*a* and 1*b* is described below. FIG. 3 is a schematic cross-sectional view of the cutter 1 according to the present disclosure. As illustrated in FIG. 3, the shuttle 7 is provided in a manner contacting the cutter rail 4 at several points to reduce vibration applied to the cutter 1, and deterioration of cutting quality can be suppressed. The cutter rail 4 further includes a first holder 3 integrally formed. The first holder 3 is movable along with movement of the cutter rail 4.

The shuttle 7 further includes a spring inside the shuttle 7, and applies force to an inner wall of the cutter rail 4 by the spring (in a direction indicated by a halftone dot arrow in FIG. 3). Thus, vibration of the shuttle 7 and the cutter rail 4 can be reduced. Additionally, the rubber roller 10 is pressed against an inner surface of the cutter rail 4 by the spring.

When the cutter 1 is driven, the shuttle 7 is operated in a cutting direction (X direction in FIG. 3) inside the cutter rail 4. When the cutter 1 is driven, the rubber roller 10 abuts on the surface of the cutter rail 4. Thus, the rubber roller 10 is rotated along with drive of the cutter 1 by friction between the cutter rail 4 and rubber on the surface of the rubber roller 10.

Furthermore, in the present disclosure, a drive transmitter 14 is provided to transmit torque from the rubber roller 10 to the round blade 1*a*. Accordingly, while the cutter 1 is driven in the direction orthogonal to the conveyance direction (Z direction in FIG. 1) of the sheet P, the round blades 1*a* and 1*b* are rotated to cut the sheet P.

Thus, the cutter 1 includes a round blade 1*a*, and the drive transmitter 14 transmits the power of the driver (cutter drive motor 5) that moves the cutter 1 in the cutting direction to the cutter to rotate the round blade 1*a* to cut the medium (sheet P).

Thus, the drive transmitter 14 transmits, to the cutter 1, the power of the driver (cutter drive motor 5) that moves the cutter 1 in the cutting direction to rotate the round blade 1*a* to cut the medium (sheet P).

Further, the cutter 1 includes two round blades 1*a* and 1*b*, edges of the two round blades 1*a* and 1*b* overlap with each other to sandwich the medium (sheet P) from the first surface and the second surface in the cutting mode.

Figure 4:
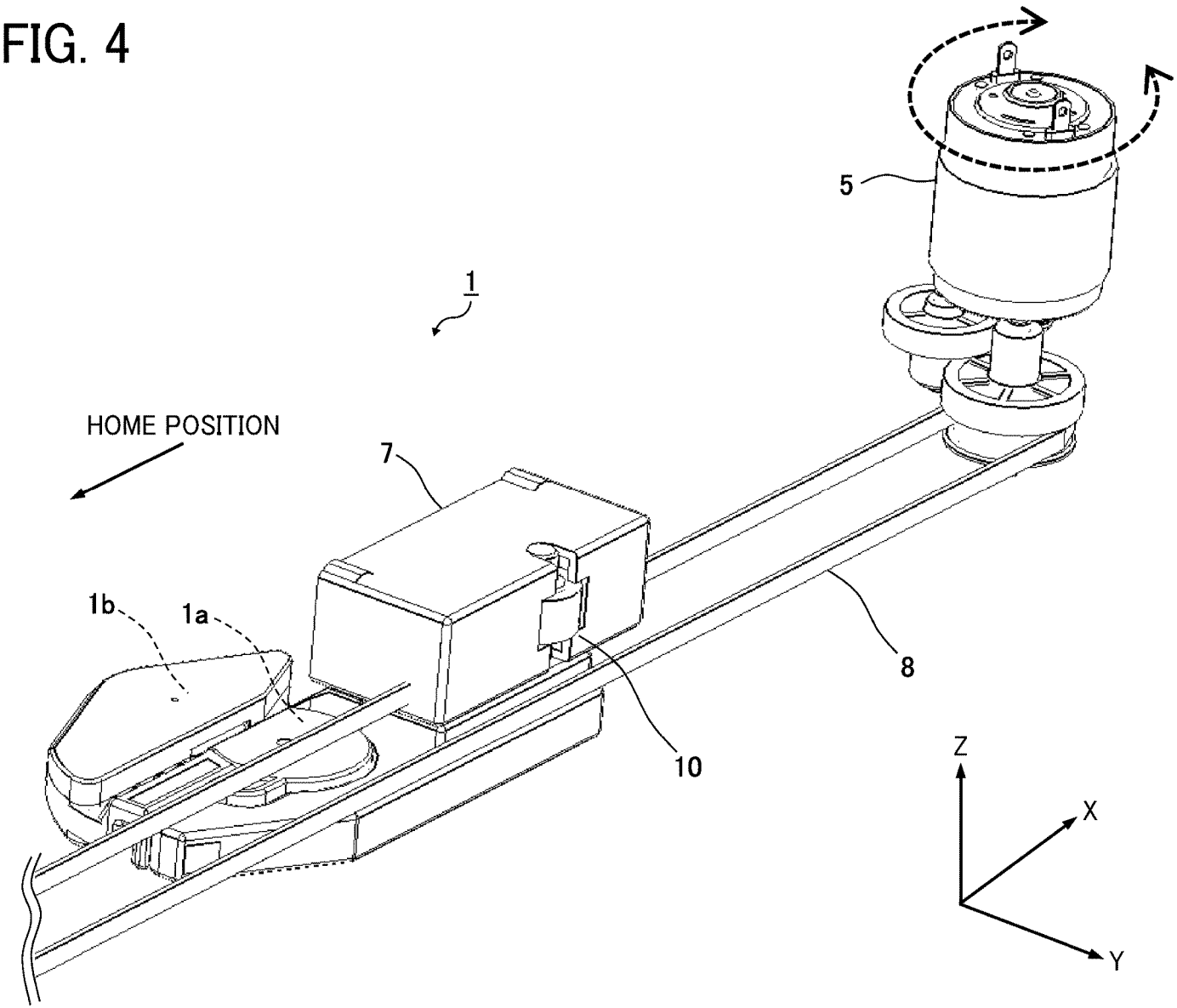
FIG. 4 is a schematic structural view of a driving mechanism of the cutter according to the embodiment of the present disclosure.

Next, a structure of a driver that drives the cutter 1 is described below. FIG. 4 is a schematic structural view of a driving mechanism of the cutter 1 according to the present disclosure. FIG. 4 schematically illustrates the cutter 1 and the driving mechanism provided as the driver that drives the cutter 1. The driving mechanism includes the shuttle 7, a drive belt 8, and a cutter drive motor 5.

The drive belt 8 is arranged inside the cutter rail 4. Note that the cutter rail 4 is omitted in FIG. 4 for sake of description. The cutter drive motor 5 is arranged on the cutter rail 4 and located on an opposite side of a home position side of the cutter 1 (opposite side of a side where cutting of the sheet P is started).

The shuttle 7 is fastened to the drive belt 8. After a signal to execute cutting operation for the sheet P is received, rotation of the cutter drive motor 5 is started, and the drive belt 8 is driven along with the rotation of the cutter drive motor 5. Thus, the cutter 1 is driven in the direction orthogonal to the conveyance direction of the sheet P. As described above, the sheet P is cut by the round blades 1*a* and 1*b* along with the drive of the cutter 1.

The cutter drive motor 5 is rotatable in a positive direction (a clockwise direction indicated by a broken line arrow in FIG. 4) and a reverse direction (a counterclockwise direction indicated by the broken line arrow in FIG. 4). The rotation of the cutter drive motor 5 is opposite between at the time of cutting drive and at the time of movement to the home position. Note that the cutter drive motor 5 is rotated in the positive direction at the time of the cutting drive, and rotated in the reverse direction at the time of movement to the home position.

Here, the "home position" represents a position (position of the cutter 1 illustrated in FIG. 1) where the cutter 1 stands by while the cutter 1 does not cut any sheet P. When the cutter 1 stands by at the home position, the cutter 1 stands by in a state that driving is stopped.

Figure 5:
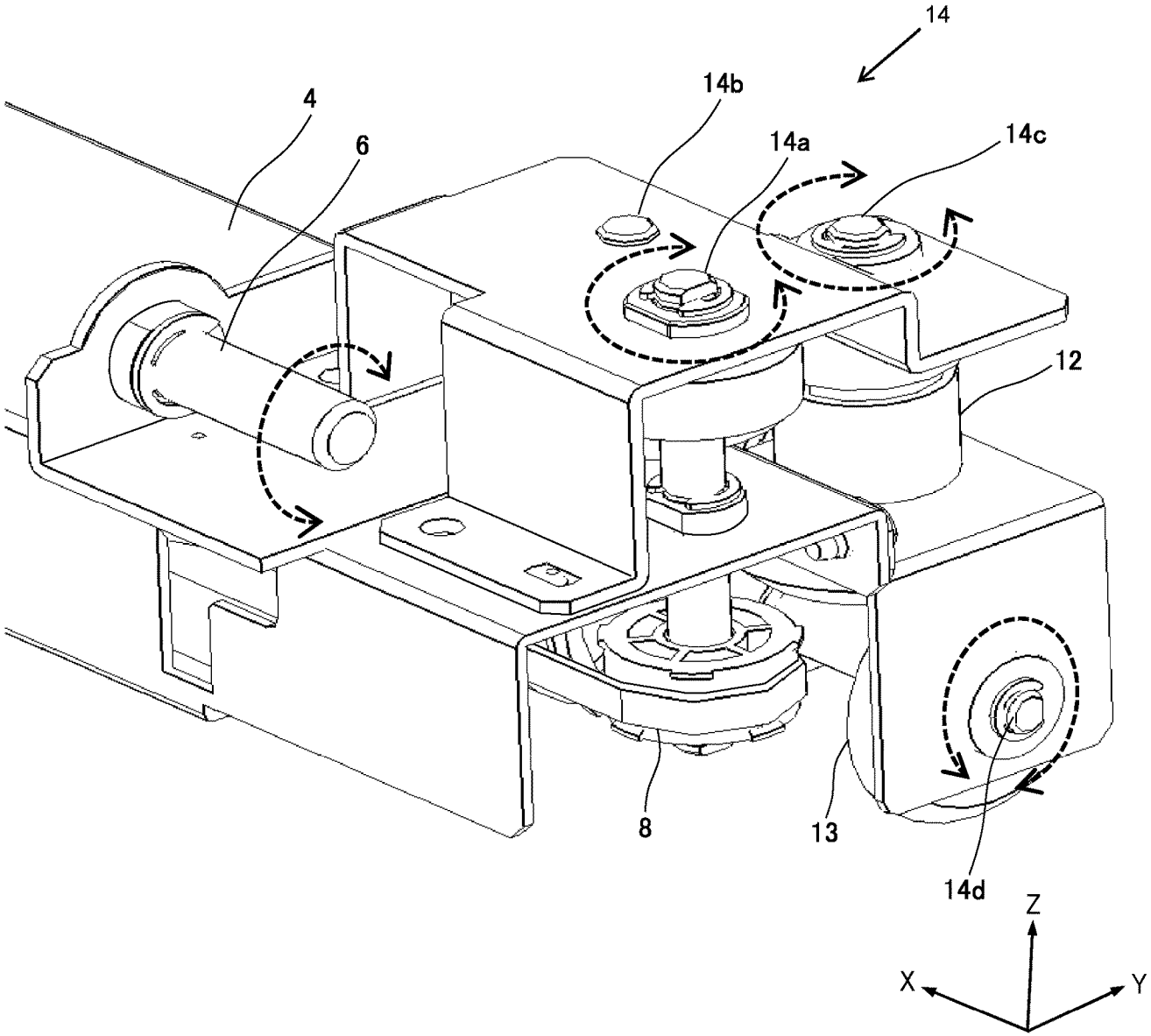
FIG. 5 is a schematic structural view of a drive transmitter according to the embodiment of the present disclosure.

Next, a structure of a drive transmitter 14 that transmits power of the cutter drive motor 5 is described below. FIG. 5 is a schematic structural view of the drive transmitter 14 according to the present disclosure. FIG. 5 illustrates a schematic structure in a view from the home position side of the drive transmitter 14 that rotates the cutter rail 4.

The cutter drive motor 5 has torque serving as power to drive the cutter 1, and the torque is transmitted to the drive transmitter 14 via the drive belt 8. The drive transmitter 14 utilizes the transmitted torque so as to move the cutter rail 4 to be swung in a manner drawing an arch shape on a YZ plane. The cutter rail 4 is a moving member that is moved around a rotation shaft 6. In other words, the cutter rail 4 is displaced relative to the conveyance path of the sheet P by the torque transmitted from the drive transmitter 14.

The drive transmitter 14 includes a shaft 14*a*, a shaft 14*b*, a shaft 14*c*, a shaft 14*d*, and gears on the respective shafts. Through the gears, the torque is transmitted from the shaft 14*a* to the shaft 14*b*, and from the shaft 14*b* to the shaft 14*c*, and then from the shaft 14*c* to the shaft 14*d*.

In the present disclosure, the shaft 14*a* (Z direction) that drives the cutter 1 and the rotation shaft 6 (X direction) of the cutter rail 4 are orthogonal to each other. Thus, a bevel gear 13 is arranged between the shaft 14*c* and the shaft 14*d* to convert a torque axis into a direction parallel to the rotation shaft 6. Thus, the cutter rail 4 is rotated.

Figure 6:
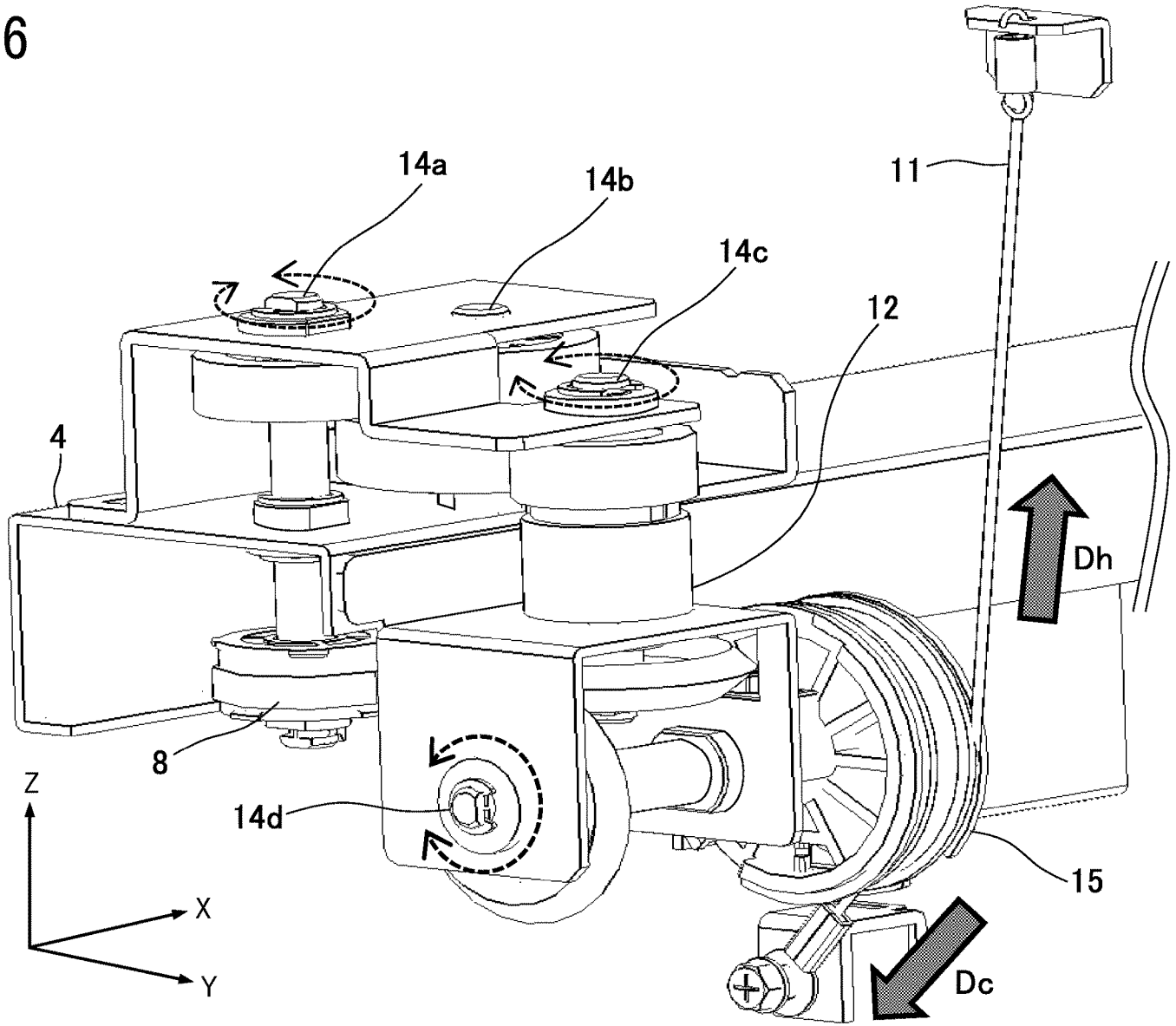
FIG. 6 is a schematic perspective view of the drive transmitter according to the embodiment of the present disclosure.
Figure 7:
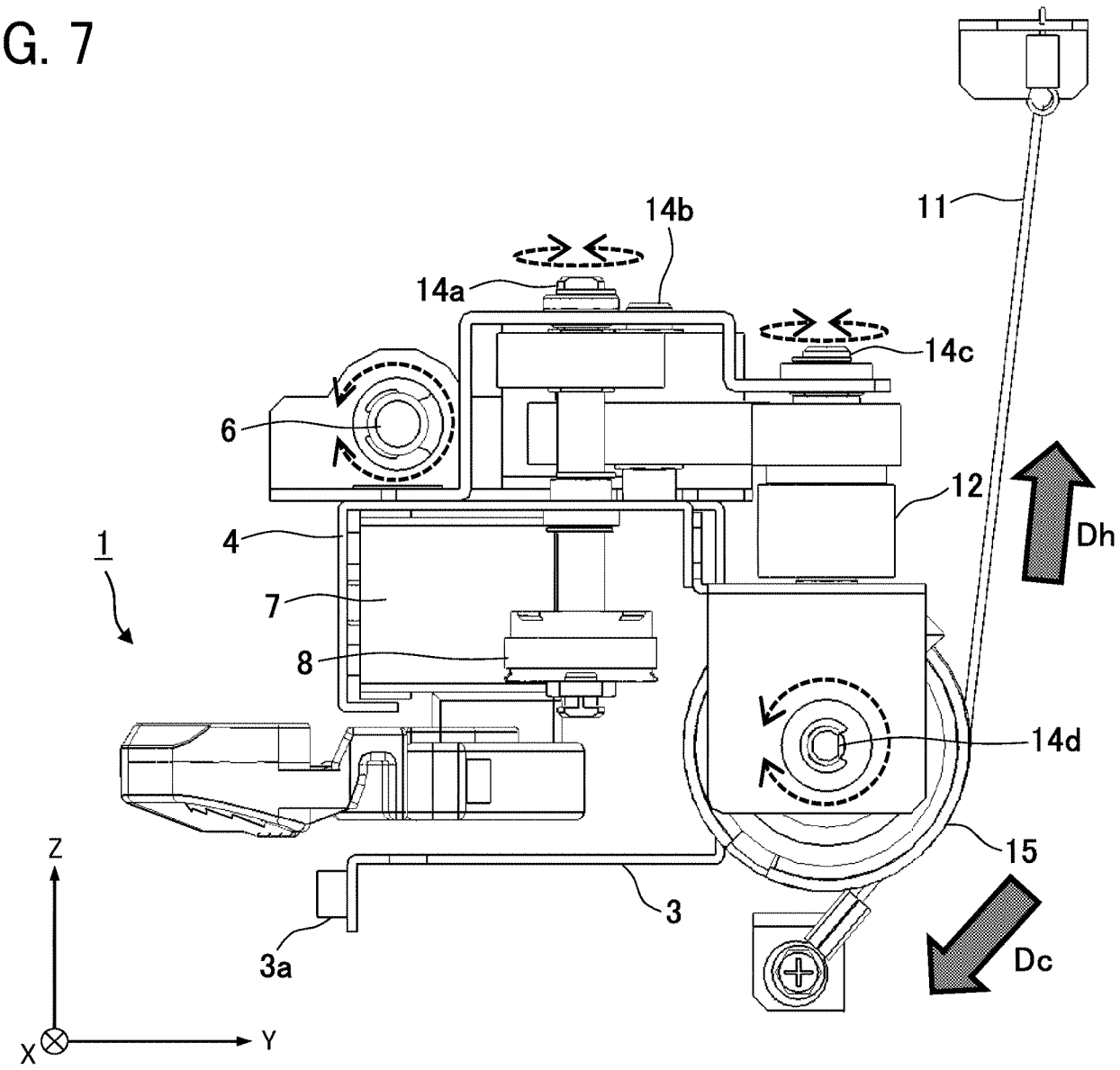
FIG. 7 is a schematic side view of the drive transmitter according to the embodiment of the present disclosure.

Next, operation of rotating the cutter rail 4 by the drive transmitter 14 is described below. FIG. 6 is a schematic perspective view of the drive transmitter 14 according to the present disclosure. Additionally, FIG. 7 is a schematic side view of the drive transmitter 14 according to the present disclosure.

As described above, the torque transmitted from the cutter drive motor 5 via the drive transmitter 14 is converted so as to rotate the cutter rail around the rotation shaft 6 or the shaft 14*d*. As illustrated in FIGS. 6 and 7, a pulley 15 around which a wire 11 is wound is arranged on an axis of the shaft 14*d*.

Positions of both ends of the wire 11 are determined such that the pulley 15 is operated in an arch-like outer periphery around the rotation shaft 6. After determination of the positions, the wire 11 is secured. The pulley 15 is rotated by the drive transmitter 14 along with the rotation of the cutter drive motor 5. Thus, the wire 11 is wound around the pulley 15.

In the present disclosure, the wire 11 positioned lower than the pulley 15 is wound up by the rotation of the cutter drive motor 5 when the cutter 1 executes the cutting drive. As a result, the cutter rail 4 is rotated around the rotation shaft 6 in the clockwise direction (in a direction indicated by an arrow Dc in FIGS. 6 and 7).

On the other hand, the wire 11 positioned higher than the pulley 15 is wounded up by the rotation of the cutter drive motor 5 when the cutter 1 is moved to the home position. As a result, the cutter rail 4 is rotated around the rotation shaft 6 in the counterclockwise direction (in a direction indicated by an arrow Dh in FIGS. 6 and 7).

Thus, the first holder 3 rotates with movement of the cutter 1, to move toward the first surface of the medium (sheet P).

Further, the second holder 2 is movable with the movement of the cutter 1, to pinch and hold the medium (sheet P) between the first holder 3 and the second holder 2 in the cutting mode.

Furthermore, the drive transmitter 14 includes a torque limiter 12 as a part of the drive transmitter 14. As a result, when the cutter rail 4 is fully rotated, the torque limiter 12 executes idling to control rotational torque of the cutter rail 4. Note that "the state in which the cutter rail 4 is fully rotated" indicates a position of the cutter rail 4 when the cutter 1 executes the cutting drive or a position of the cutter rail 4 when the cutter 1 stands by at the home position. The torque limiter 12 controls torque of the first holder 3 to hold the medium (sheet P).

With the above-described structure, the medium cutter 20 according to the present disclosure can reduce a rotation region of the cutter rail 4, and also can easily control the rotation of the cutter rail 4. Thus, such control of the rotation of the cutter rail 4 can control a holding condition of a sheet P by the first holder 3.

Figure 8:
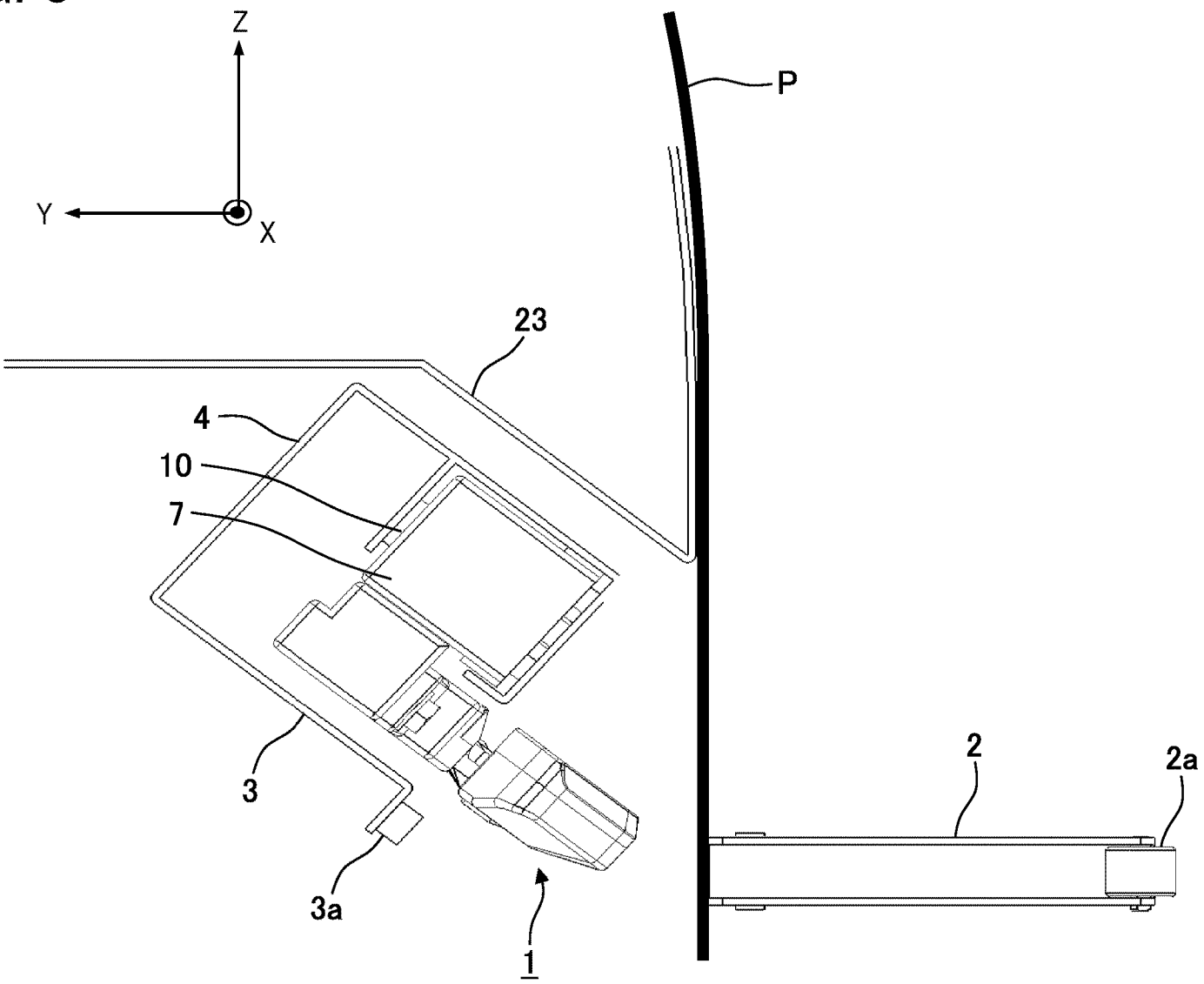
FIG. 8 is a view illustrating an operation of a medium holding mechanism during a standby mode according to the embodiment of the present disclosure.
Figure 9:
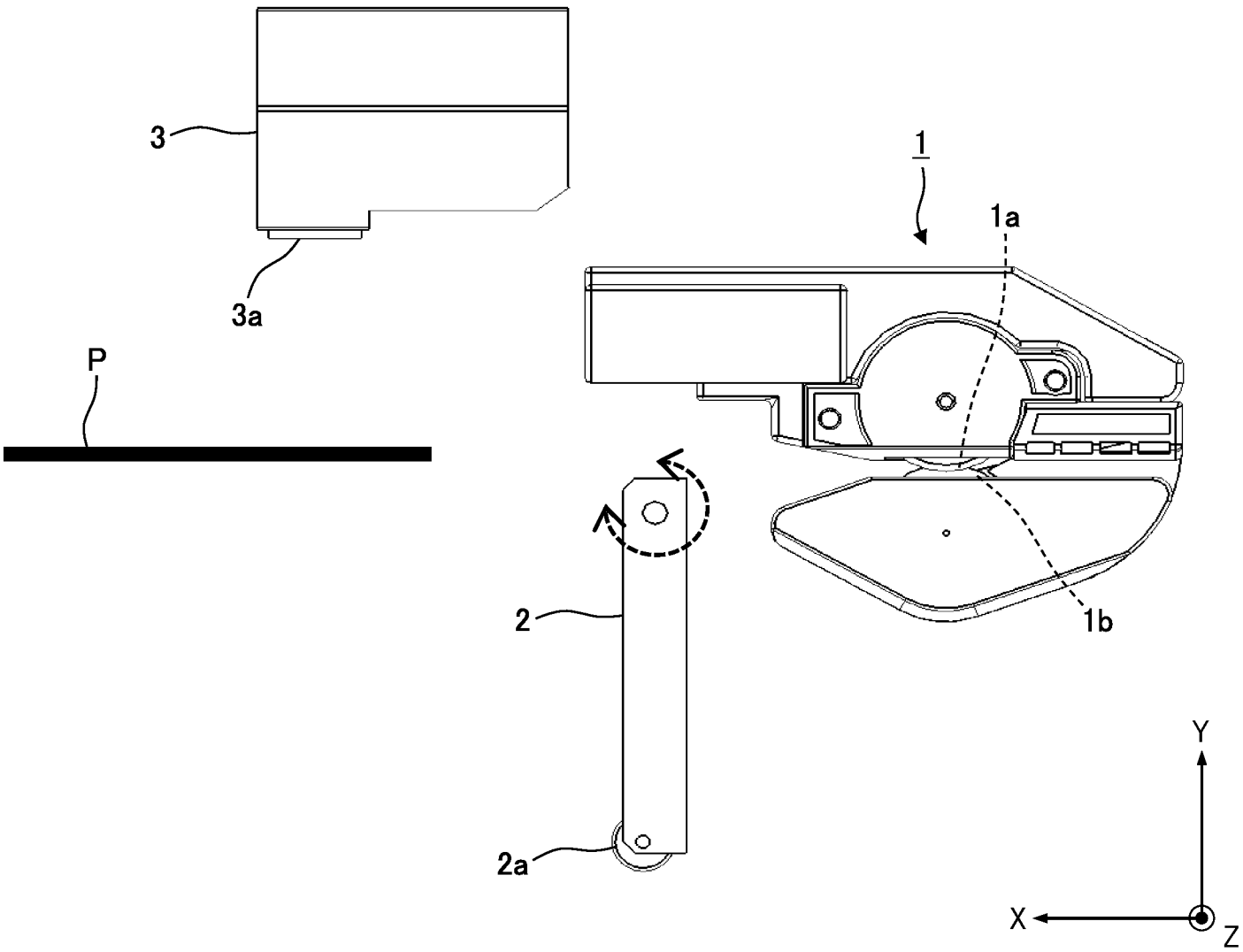
FIG. 9 is a view illustrating the operation of the medium holding mechanism during the standby mode according to the embodiment of the present disclosure.

Next, it is described below an operation of the medium holding mechanism for a sheet P when the cutter 1 stands by at the home position during the standby mode. FIG. 8 is a side view illustrating an operation of the medium holding mechanism during the standby mode according to the present disclosure. Additionally, FIG. 9 is a top view illustrating the operation of the medium holding mechanism during the standby mode according to the present disclosure. Note that FIGS. 8 and 9 illustrate an exemplary positional relation between the cutter 1, the medium holding mechanism, and a sheet P. The medium holding mechanism includes the first holder 3 and a second holder 2.

The medium holding mechanism includes: the first holder 3 integrally formed with the cutter rail 4; and the second holder 2 formed so as to hold the sheet P from the second surface. The second holder 2 is rotated around the Z direction in FIGS. 8 and 9.

Figure 10:
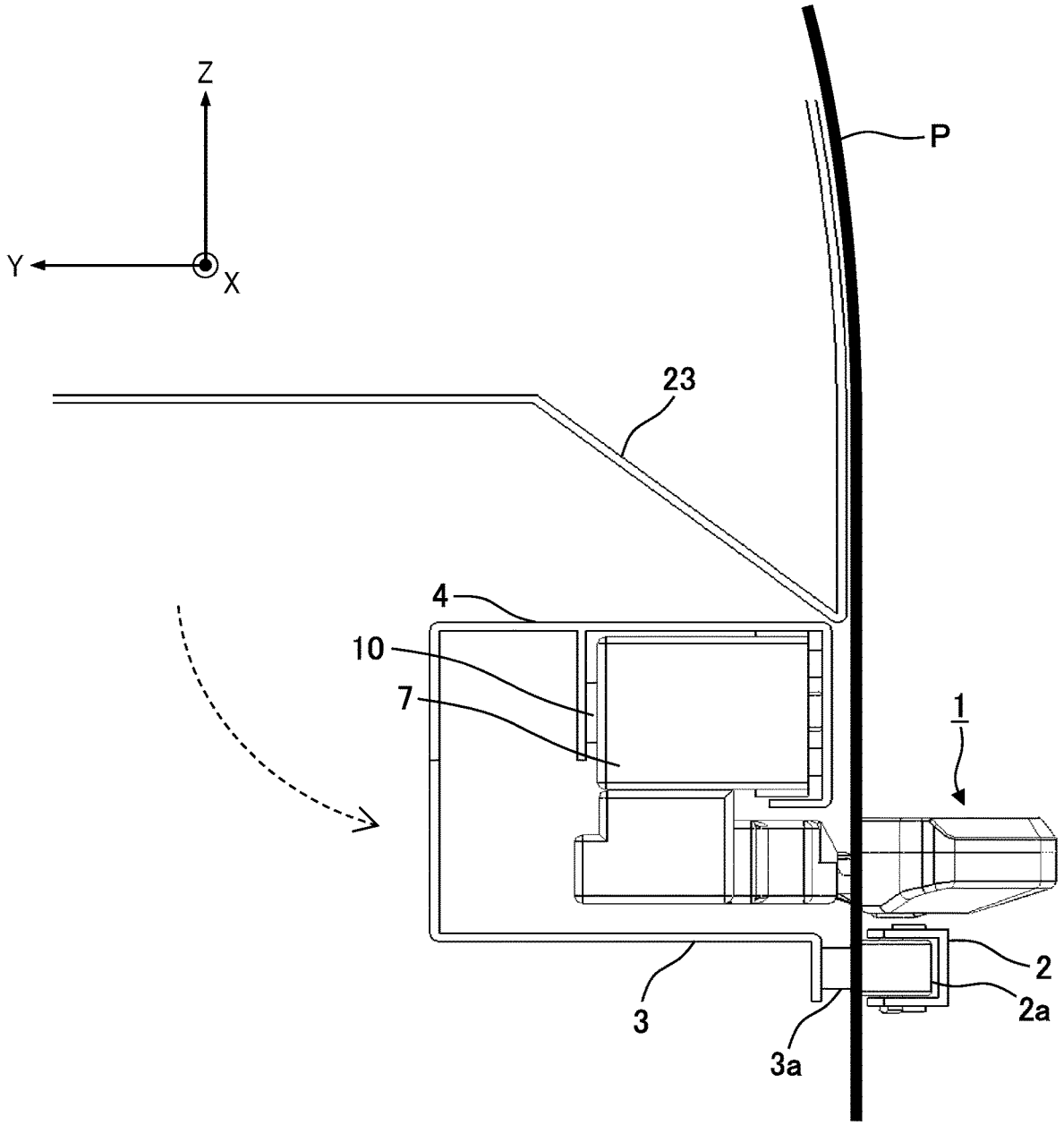
FIG. 10 is a view illustrating an operation of the medium holding mechanism during cutting operation according to the embodiment of the present disclosure.

As illustrated in FIG. 3, the first holder 3 is disposed downstream of the cutter 1 in the conveyance direction of the sheet P (negative Z direction or downward direction in FIG. 3), and the first holder 3 moves to the one end of medium (sheet P) to pinch and hold the one end of medium (sheet P) between the first holder 3 and the second holder 2 (see FIGS. 8 and 10).

The first holder 3 includes a holder 3*a* including a rubber material having a high friction coefficient. The second holder 2 includes a roller 2*a* including a resin material having a good sliding property (here, polyacetal (POM), for example).

The holder 3*a* holds the sheet P from the first surface of the sheet P (the surface of the sheet P moved from A to B as indicated by the shaded arrow in FIG. 1). On the other hand, the roller 2*a* holds the sheet P from the second surface of the sheet P (the surface of the sheet P moved from B to A as indicated by the shaded arrow in FIG. 1).

Accordingly, the holder 3*a* and the roller 2*a* are provided as contact members to pinch (sandwich) and hold the sheet P from the first surface and the second surface, more specifically, pinch (sandwich) the sheet P from front and back sides. Note that the holder 3*a* and the roller 2*a* may include a material other than the materials as described above, but it is preferable to use a material which can hold the sheet P and does not give any damage such as a scratch to the sheet P.

As illustrated in FIG. 8, in a case where the cutter 1 is not operated (in the standby mode) or is positioned at the home position, the cutter rail 4 is arranged in a state inclined with respect to the conveyance path of the sheet P. Accordingly, in the case where the cutter 1 is in the standby mode or positioned at the home position, the first holder 3 and the second holder 2 are also separated from the conveyance path of the sheet P.

Since the cutter rail 4, the first holder 3, and the second holder 2 are arranged so as to be separated from the conveyance path of the sheet P, it is possible to prevent a change in a conveyance load caused by the first holder 3 or the second holder 2 contacting the sheet P that is being conveyed. With the above-described structure, the medium cutter 20 can prevent an adverse effect (blurred print or an ink stain) on an image formed on the sheet P.

Furthermore, in the medium cutter 20 according to the present disclosure, as described above, when the cutter 1 starts to move toward the home position is started, the cutter rail 4 is rotated around the rotation shaft 6 and moved in a manner drawing an arc shape on the YZ plane in FIG. 8. When the cutter 1 starts to move to the home position, rotational force by the drive transmitter 14 acts such that a posture of the cutter rail 4 is inclined with respect to a conveyance surface of the conveyance path of the sheet P as illustrated in FIG. 8.

Accordingly, when the cutter 1 is moved toward the home position after completion of cutting operation, and when the driving of the cutter 1 is stopped, the cutter 1 is moved while keeping the posture inclined with respect to the conveyance surface of the conveyance path of the sheet P as illustrated in FIG. 8. More specifically, the cutter 1 is also moved to a position not contacting the sheet P along with the movement of the cutter rail 4. Thus, since the cutter 1 is arranged in a manner not contacting the sheet P that remains on an upstream side of a guide plate 23 after cutting the sheet P, it is possible to prevent the sheet P from being scratched by the contact with the cutter 1.

Figure 11:
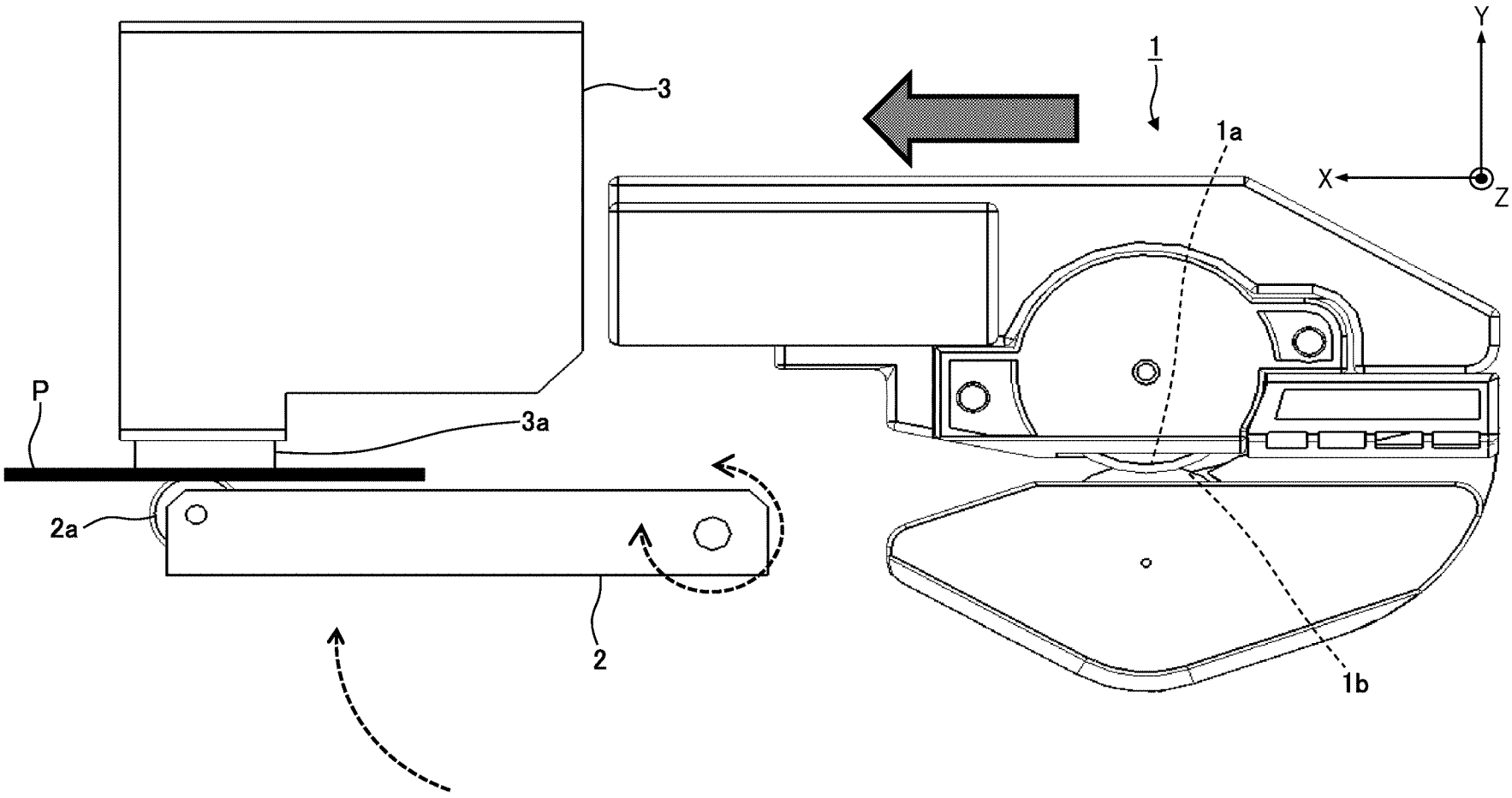
FIG. 11 is a view illustrating the operation of the medium holding mechanism during the cutting operation according to the embodiment of the present disclosure.

Next, operation of the medium holding mechanism for a sheet P when the cutter 1 executes the cutting operation is described below. FIG. 10 is a side view illustrating an operation of the medium holding mechanism during the cutting operation according to the present disclosure. Additionally, FIG. 11 is a top view illustrating the operation of the medium holding mechanism during the cutting operation according to the present disclosure. Note that FIGS. 10 and 11 illustrate an exemplary positional relation between the cutter 1, the medium holding mechanism, and a sheet P. The medium holding mechanism includes the first holder 3 and the second holder 2.

As illustrated in FIG. 10, in a case of executing the operation to cut the sheet P, the cutter rail 4 is moved in a direction approaching the conveyance path of the sheet P. Additionally, the cutter 1 approaches the conveyance path of the sheet P along with the movement of the cutter rail 4, and is moved to a position capable of cutting the sheet P while sandwiching the sheet P by the round blades 1*a* and 1*b*. Furthermore, the second holder 2 is rotated in a direction in which the rollers 2*a* approach the conveyance path of the sheet P along with the movement of the cutter rail 4.

Accordingly, when the cutter 1 executes the cutting operation, the first holder 3 and the second holder 2 abut on the sheet P. Meanwhile, as a component that operates the second holder 2, it may be possible to provide a guide that rotates the second holder 2 when the cutter rail 4 is operated, or it may possible to transmit the torque of the cutter drive motor 5 by providing a gear, a belt, or the like different from the drive transmitter 14.

Since the first holder 3 and the second holder 2 are arranged in a manner abutting on the conveyance path of the sheet P, the sheet P can be held from the first surface and the second surface. Additionally, since the first holder 3 is a member formed integrally with the cutter rail 4, the first holder 3 is provided in an entire width direction of the sheet P. Thus, in a case in which one end of the sheet P on the side (right end side in FIG. 16) at which the cutting is started is held by the second holder 2 and the first holder 3, the sheet P can be prevented from hanging down by the self-weight even when the cutting of the sheet P has progressed.

Figure 16:
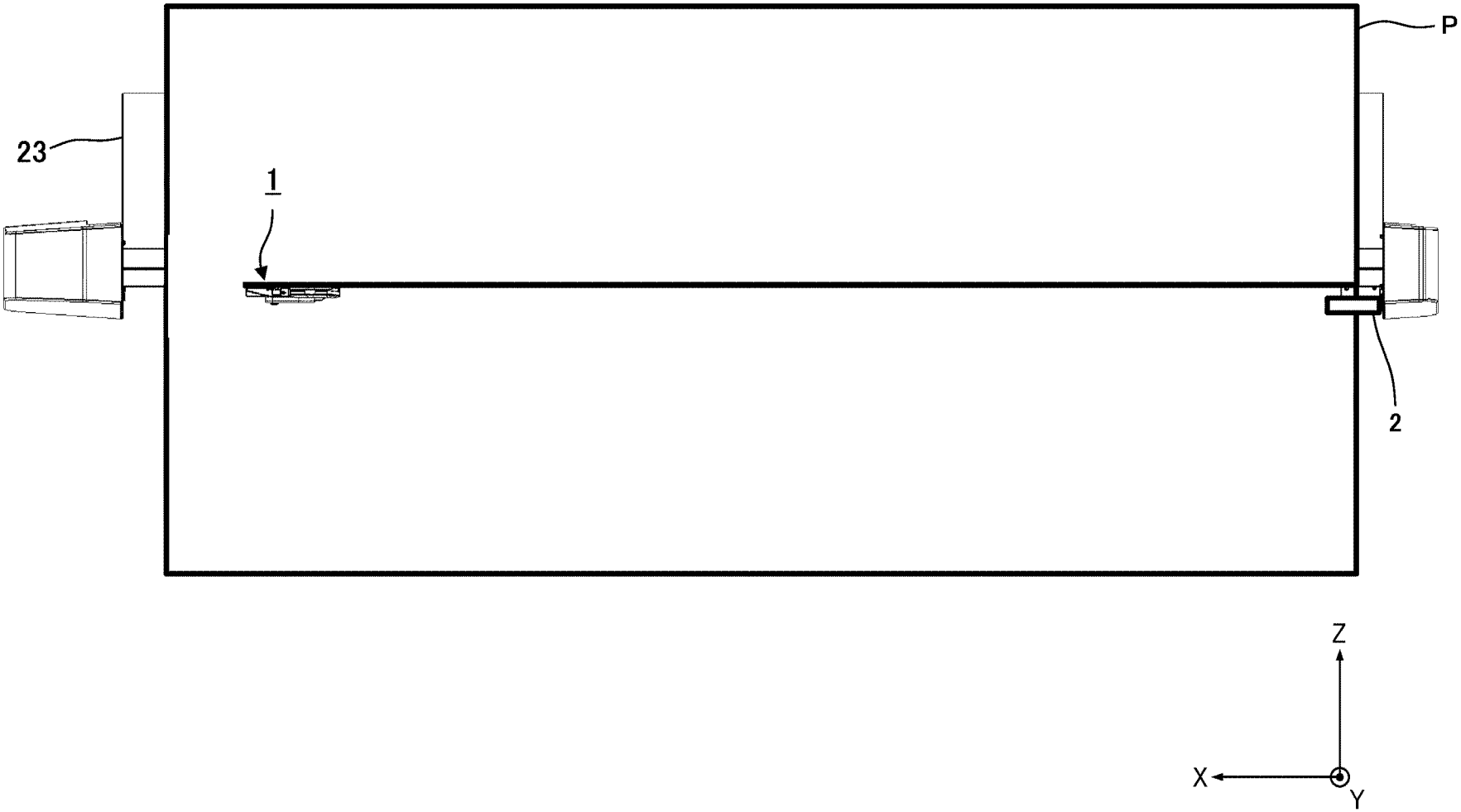
FIG. 16 is an explanatory view to describe a medium cutting mode according to the embodiment of the present disclosure.

The one end of the sheet P is a right end of the sheet P in FIG. 16 in a cutting direction (X direction in FIG. 16) orthogonal to the conveyance direction (Z direction in FIG. 16) of the sheet P. The cutting direction is parallel to a width direction of the sheet P.

Additionally, when the cutter 1 finishes cutting of the sheet P, the cutter 1 is moved toward the home position. When the cutter finishes cutting of the sheet P, the cutter rail 4 is moved from the position of the cutter rail 4 illustrated in FIG. 10 to the position of the cutter rail 4 illustrated in FIG. 8 along with the movement of the cutter 1.

When the cutter 1 is moved toward the home position, the cut sheet P held in a manner pinched (sandwiched) and held between the first holder 3 and the second holder 2 is released from the state held by the first holder 3 and the second holder 2 along with the movement of the cutter rail 4. Thus, every time a sheet P is cut, it is possible to obtain the sheet P having an image formed on the sheet P even without a process in which a user removes the sheet P from the medium holding mechanism.

Figure 12:
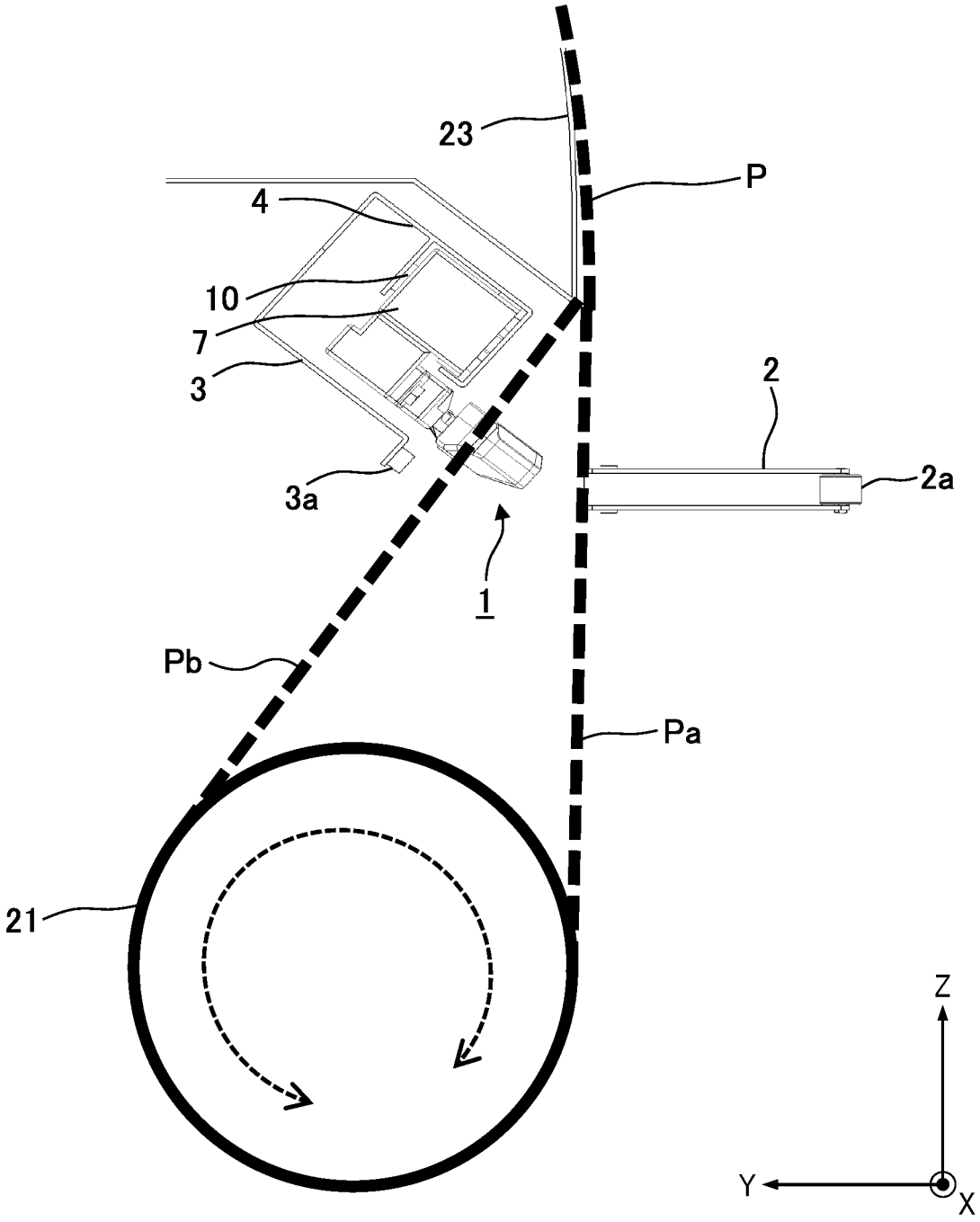
FIG. 12 is a schematic diagram illustrating a positional relation between a cutting mechanism and a winding device during the standby mode according to the embodiment of the present disclosure.
Figure 13:
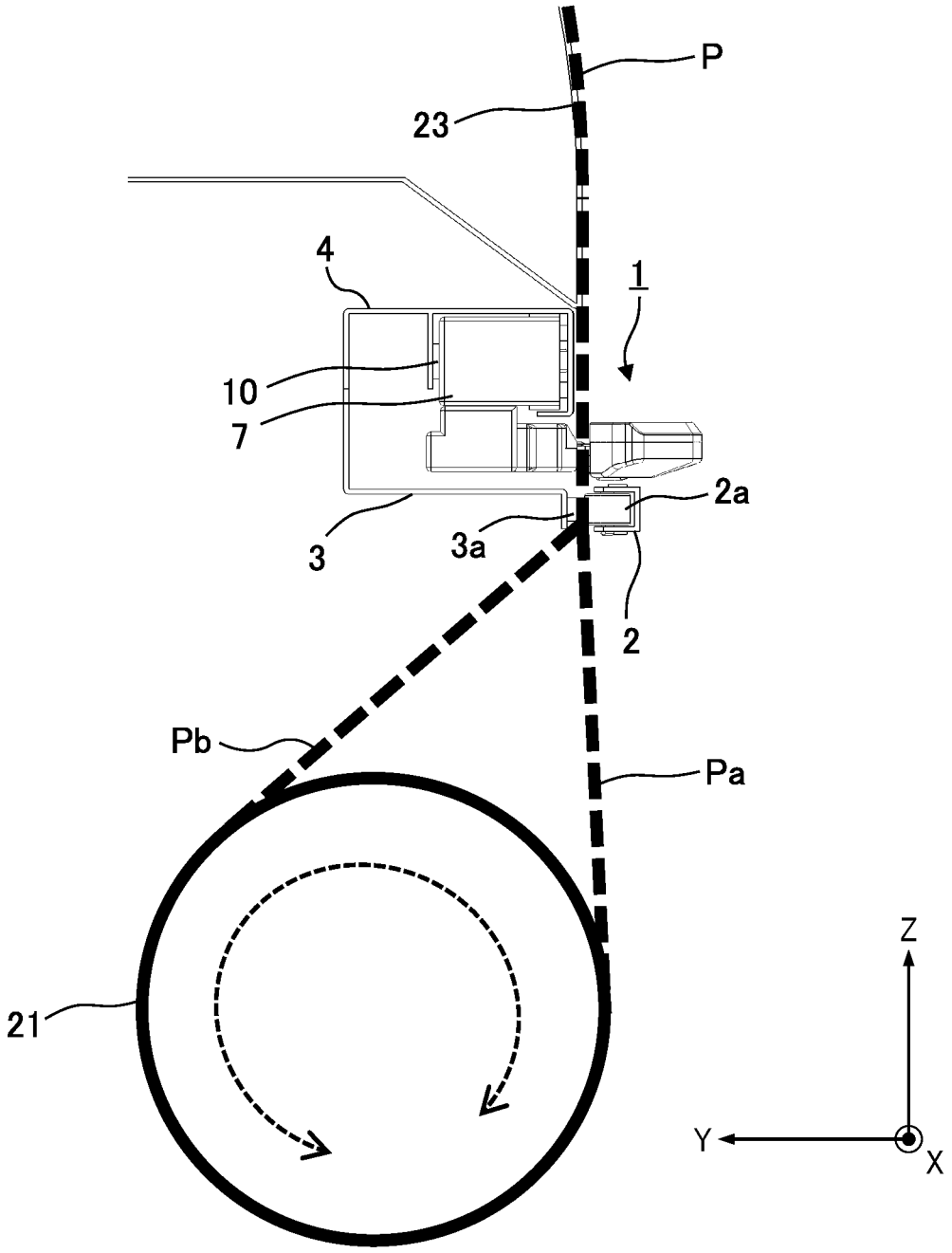
FIG. 13 is a schematic diagram illustrating a positional relation between the cutting mechanism and the winding device during the cutting operation according to the embodiment of the present disclosure.

Next, a positional relation between the medium cutter 20 and the winding device 21 (21*a* and 21*b*) is described below. FIG. 12 is a schematic diagram illustrating the positional relation between the cutter 1 of the medium cutter 20 and the winding device 21 during the standby mode according to the present disclosure. Additionally, FIG. 13 is a schematic diagram illustrating the positional relation between the cutter 1 of the medium cutter 20 and the winding device 21 during the cutting mode (cutting operation) according to the present disclosure. As illustrated in FIG. 1, the winding device 21 includes left winder 21*a* and right winder 21*b*.

In FIGS. 12 and 13, advantages obtained by moving the cutter rail 4 is described below. As described above, a sheet P ejected from the sheet ejection port 22 is wound up by the winding device 21. In the present disclosure, a user can select whether the sheet P is to be wounded up by inner winding Pb or outer winding Pa in the winding device 21.

When the sheet P ejected from the sheet ejection port 22 is wound up by the winding device 21, as indicated by dotted lines in FIG. 12, an angle of the conveyance path of the sheet P from the guide plate 23 to the winding device 21 is different between the inner winding Pb and the outer winding Pa. When the angle of the conveyance path of the sheet P is different, a conveyance load caused by the roller 2*a* and the holder 3*a* contacting the sheet P is changed. Thus, there is a concern such that blurred print or an ink stain may be occurred on an image formed on the sheet P.

On the other hand, as illustrated in FIG. 12, in the case where the winding device 21 executes the inner winding Pb, the cutter rail 4 during the standby mode is arranged so as to stand by at a position where the holder 3*a* does not contact the conveyance path of the sheet P.

Furthermore, as illustrated in FIG. 13, the cutter rail 4 is moved such that the sheet P is held by the first holder 3 during the cutting operation. Accordingly, the sheet P is pushed in a negative direction of the Y axis even in the case where the winding device 21 executes the inner winding Pb. As a result, the sheet P can be held in a state of being pinched (sandwiched) and held between the roller 2*a* and the holder 3*a*.

When the sheet P is held between the roller 2*a* and the holder 3*a*, the self-weight of the cutter rail 4, an idling torque value of the torque limiter 12, a torque value of the cutter drive motor 5, and a winding torque value of the winding device 21 are set to predetermined values. Consequently, rotational force of the cutter rail 4 can withstand tension of the sheet P. Accordingly, the sheet P can be stably held by the first holder 3 and the second holder 2 regardless of whether the sheet P is wound up by the inner winding Pb or the outer winding Pa with the winding device 21.

Figure 14:
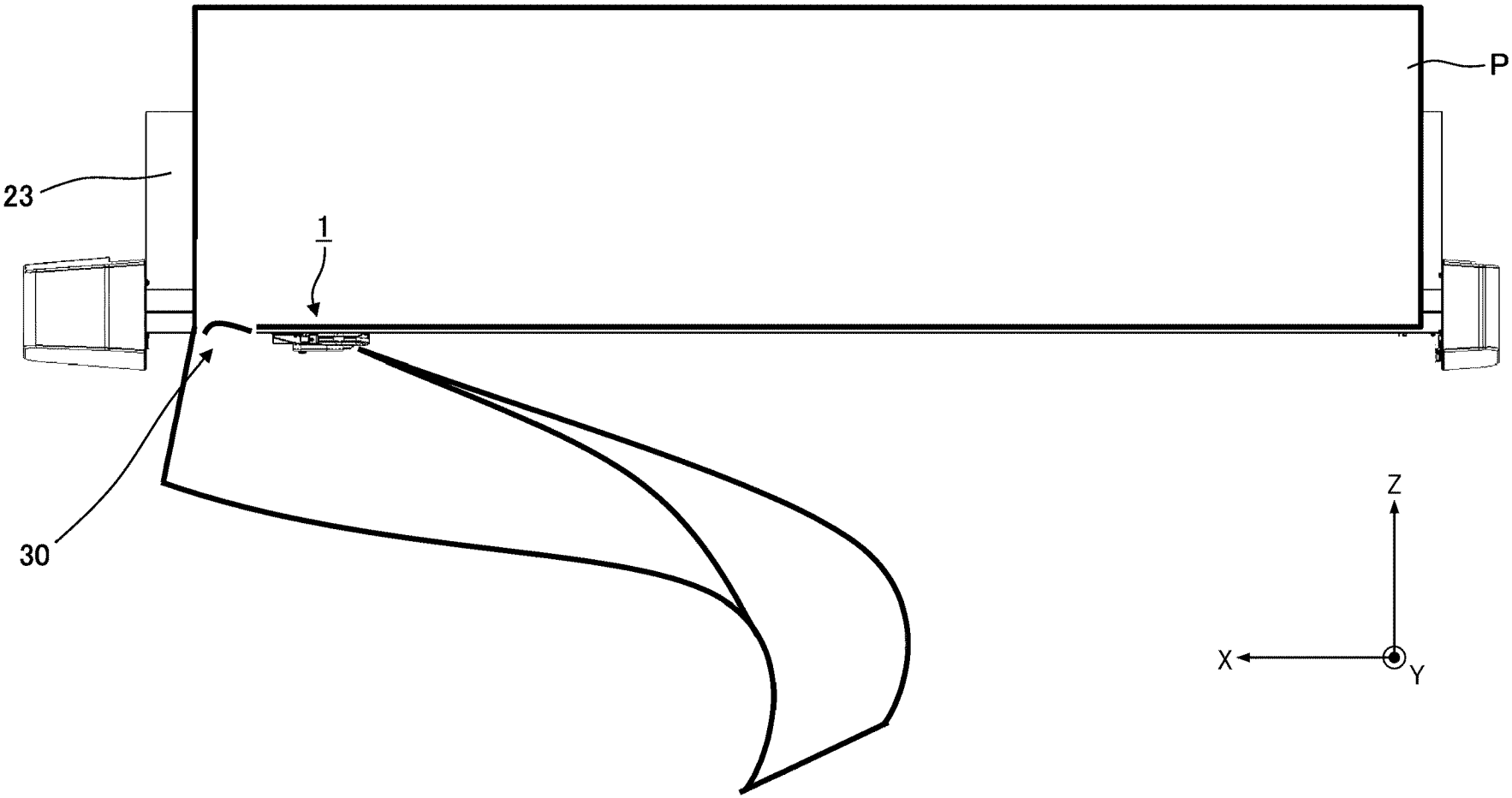
FIG. 14 is an explanatory view to describe a medium cutting mode in a medium cutter.
Figure 15:
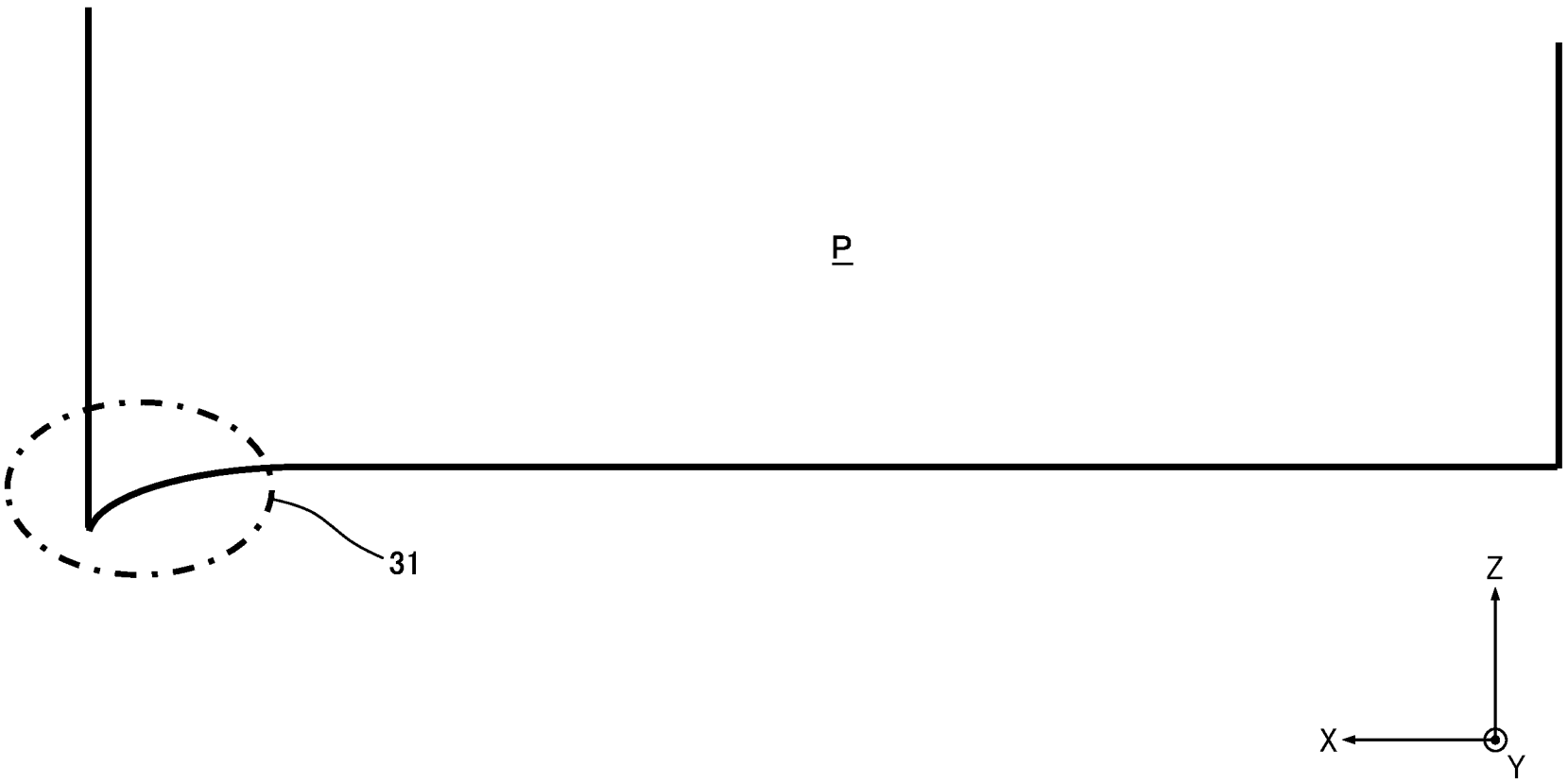
FIG. 15 is a diagram illustrating one end of a medium cut by the medium cutter.

Finally, a medium cutting mode is described below. FIG. 14 is a schematic view illustrating a cutting mode of a sheet P cut by a medium cutter in which an end of the sheet P is not held by the medium cutter. FIG. 15 is a diagram illustrating cutting of a sheet Pin a case in which the sheet P is cut by the medium cutting mechanism illustrated in FIG. 14.

As illustrated in FIG. 14, the sheet P conveyed from the sheet ejection port 22 gradually hangs down from a cut place due to the self-weight. When the sheet P is conveyed from the sheet ejection port 22, since the sheet P hangs down due to the self-weight, a twist 30 of the sheet P is occurred on an uncut portion of the sheet P on extension from the cut place. When the sheet P is cut in the state in which the twist 30 of the sheet P is occurred, cutting failure such as bending of a cut surface by the twist 30 of the sheet P occurs at an end of the cut surface of the sheet P as illustrated in FIG. 15.

Figure 17:
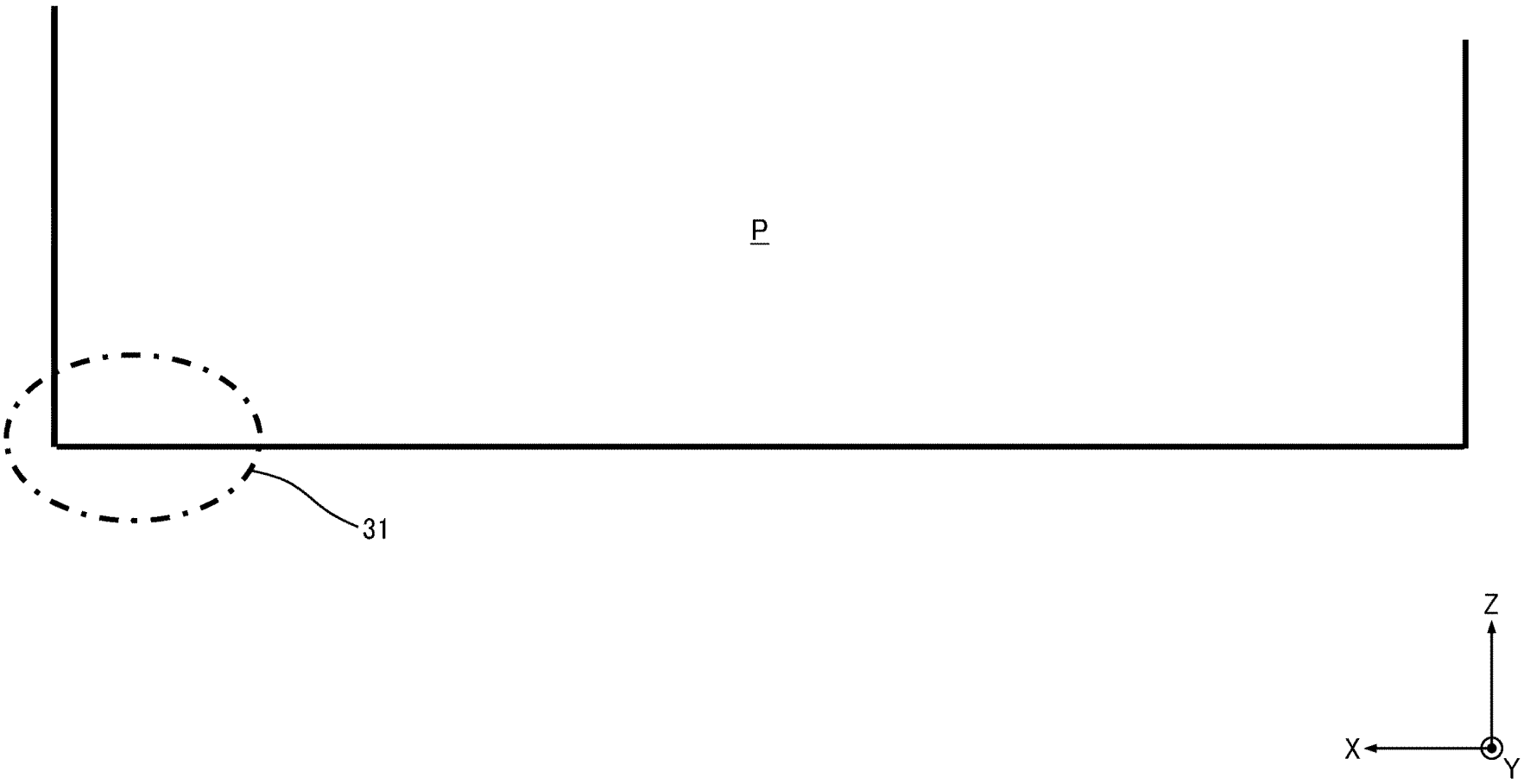
FIG. 17 is a diagram illustrating one end of a medium cut by the medium cutter according to the embodiment of the present disclosure.

FIG. 16 is a schematic view illustrating a cutting mode of a sheet P of the medium cutter 20 according to the present disclosure. FIG. 17 is a diagram illustrating cutting of a sheet Pin a case of cutting the sheet P by the medium cutter 20. As illustrated in FIG. 16, a right end of the sheet P in the cutting direction (width direction of the sheet P) is pinched (sandwiched) and held between the first holder 3 and the second holder 2 in the medium cutter 20 according to the present disclosure. The cutter 1 starts cutting from the right end of the sheet P in the cutting direction (width direction) of the sheet P.

With the above-described structure, the right end of the sheet P is kept in the state held between the first holder 3 and the second holder 2 even when the cutting has progressed to a left end of the sheet P by the cutter 1. Thus, the sheet P is prevented from hanging down due to the self-weight in the middle of the cutting.

Accordingly, the twist 30 of the sheet P does not occur, and bending of the cut surface at one end of the sheet P can be suppressed as illustrated in FIG. 17. Thus, the cutting failure caused by the self-weight of the sheet P can be reduced. Furthermore, the medium cutter 20 does not require a front surface of a sheet P to be pinched (sandwiched) and held between the first holder 3 and the second holder 2 in an entire cutting direction of the sheet P. Thus, the structure of the medium holding mechanism to hold the sheet P can be simplified.

Meanwhile, in the present disclosure, the description has been provided for the example in which the sheet P is held in the state pinched (sandwiched) between the first holder 3 and the second holder 2 when the cutter 1 executes cutting, and the sheet P pinched (sandwiched) between the first holder 3 and the second holder 2 is released when the cutter 1 is moved toward the home position. Not limited to the above-described example, the first holder 3 and the second holder 2 may release the sheet P at the same time when the cutting of the sheet P is finished.

As described above, the medium cutter 20 according to the present disclosure can improve the cutting quality for a sheet P. Furthermore, since the cutter rail 4 and the first holder 3 are simply structured such that a holding state of a sheet P is changed with the movement of the cutter 1, the cutting work for a sheet P can be efficiently executed without a process of removing each sheet P from the medium holding mechanism every time the sheet P is cut.

Thus, the medium cutter 20 according to the present disclosure can efficiently perform cutting work while preventing cutting failure caused by the self-weight of the sheet.

Numerous additional modifications and variations are possible in light of the above teachings. It is thus to be understood that, within the scope of the above teachings, the present disclosure may be practiced otherwise than as specifically described herein. With some embodiments having thus been described, it will be obvious that the same may be varied in many ways. Such variations are not to be regarded as a departure from the scope of the present disclosure and appended claims, and all such modifications are intended to be included within the scope of the present disclosure and appended claims. For example, in a case of applying the structure according to the present disclosure to a cut sheet or a continuous sheet other than a roll sheet as a sheet P, the similar effects can also be obtained.

What is claimed is:

1. A medium cutter comprising:

a conveyor configured to convey a medium, comprising a sheet on which an image has been formed, in a conveyance direction;

a cutter configured to cut the medium by moving from one end of the medium in a cutting direction orthogonal to the conveyance direction, wherein the cutter includes a shuttle driven along a cutter rail, and overlapping blades arranged on separate surfaces of the medium that are rotated while sandwiching the sheet to cut the sheet;

a first holder disposed downstream of the cutter in the conveyance direction and integrally formed with the cutter rail, wherein the first holder is configured to rotate with the cutter rail around a rotation shaft to contact a first surface of the medium;

a second holder configured to contact a second surface of the one end of the medium opposite the first surface to pinch and hold the one end of the medium between the first holder and the second holder;

a driver configured to move the cutter in the cutting direction; and a drive transmitter configured to transmit power of the driver to the cutter, wherein the first holder is rotated around the rotation shaft by the power transmitted from the driver via the drive transmitter.

2. The medium cutter according to claim 1, wherein the first holder is configured to rotate around the rotation shaft in a first direction to contact the first surface of the medium in a cutting mode in which the cutter cuts the medium, and the first holder is configured to rotate around the rotation shaft in a second direction opposite the first direction to separate from the first surface of the medium in a standby mode in which the cutter does not cut the medium.

3. The medium cutter according to claim 1, wherein:

the second holder is configured to rotate toward and away from the second surface of the medium.

4. The medium cutter according to claim 1, wherein the first holder is provided in an entire width direction of the sheet.

5. The medium cutter according to claim 1, wherein the drive transmitter includes a torque limiter configured to control torque of the first holder to hold the medium.

6. The medium cutter according to claim 1, wherein the second holder is movable with movement of the cutter to pinch and hold the medium between the first holder and the second holder in a cutting mode.

7. The medium cutter according to claim 1, wherein the drive transmitter includes a wire wound around a pulley to rotate the first holder.

8. The medium cutter according to claim 1, wherein the drive transmitter transmits, to the cutter, the power of the driver that moves the cutter in the cutting direction to rotate the blades to cut the medium.

9. The medium cutter according to claim 1, wherein the blades comprise round blades.

10. A liquid discharge apparatus comprising:

a liquid discharge head configured to discharge a liquid to the medium; and the medium cutter according to claim 1.

* * * * *